US009132453B1

(12) United States Patent
Bouslog

(10) Patent No.: US 9,132,453 B1
(45) Date of Patent: Sep. 15, 2015

(54) SYSTEMS AND METHODS FOR SEPARATING METAL FROM RUBBER

(71) Applicant: Gregg L. Bouslog, Laguna Niguel, CA (US)

(72) Inventor: Gregg L. Bouslog, Laguna Niguel, CA (US)

( * ) Notice: Subject to any disclaimer, the term of this patent is extended or adjusted under 35 U.S.C. 154(b) by 0 days.

(21) Appl. No.: 14/624,214

(22) Filed: Feb. 17, 2015

Related U.S. Application Data

(60) Provisional application No. 61/946,746, filed on Mar. 1, 2014.

(51) Int. Cl.
*B07B 13/10* (2006.01)
*B07B 4/02* (2006.01)

(52) U.S. Cl.
CPC ..... *B07B 4/02* (2013.01)

(58) Field of Classification Search
CPC ..... B07B 3/10; B07B 4/02; B07B 4/025; B07B 4/0251
USPC ..... 209/631, 638, 639, 641, 935
See application file for complete search history.

(56) References Cited

U.S. PATENT DOCUMENTS

| | | | | | |
|---|---|---|---|---|---|
| 916,625 | A | * | 3/1909 | Stein | 209/33 |
| 1,042,836 | A | * | 10/1912 | Stromborg | 209/135 |
| 2,828,011 | A | * | 3/1958 | Whitby | 209/20 |
| 2,978,103 | A | | 4/1961 | Cowher, Sr. | |
| 3,385,436 | A | * | 5/1968 | Murphy | 209/135 |
| 4,486,300 | A | * | 12/1984 | Prieb | 209/135 |
| 4,490,247 | A | | 12/1984 | Forsberg et al. | |
| 4,728,109 | A | | 3/1988 | Simonetti | |
| 5,032,256 | A | * | 7/1991 | Vickery | 209/135 |
| 5,085,765 | A | | 2/1992 | Salabe et al. | |
| 5,732,829 | A | | 3/1998 | Smith | |
| 5,934,477 | A | | 8/1999 | Smith | |
| 5,934,482 | A | | 8/1999 | Smith | |
| 5,967,333 | A | | 10/1999 | Smith | |
| 6,631,808 | B2 | * | 10/2003 | Sparks | 209/33 |
| 6,883,668 | B1 | | 4/2005 | Lindsey et al. | |
| 6,978,899 | B2 | * | 12/2005 | Kokko | 209/639 |
| 7,237,680 | B2 | | 7/2007 | Viny | |
| 7,267,230 | B1 | | 9/2007 | Smith | |
| 8,226,019 | B2 | * | 7/2012 | Andersen | 241/19 |
| 2002/0175113 | A1 | * | 11/2002 | Tahkanen | 209/639 |
| 2007/0221549 | A1 | | 9/2007 | Liu | |
| 2011/0132814 | A1 | | 6/2011 | Miller | |

FOREIGN PATENT DOCUMENTS

| | | |
|---|---|---|
| DE | 102005008210 | 8/2009 |
| JP | 2010-188275 | 9/2010 |

* cited by examiner

*Primary Examiner* — Joseph C Rodriguez
(74) *Attorney, Agent, or Firm* — Knobbe Martens Olson & Bear LLP

(57) ABSTRACT

Devices, method, and systems are described for separating metallic objects, such as bullets, from non-metallic objects, such as rubber pieces. In one embodiment, a separator includes a first conveyor, a blower, and a collector. A mixture of metallic and rubber objects are loaded onto the first conveyor and dropped in front of the blower. The blower directs forced air at the rubber and metal mixture, wherein due to the differing physical properties of the two materials, the rubber objects may be laterally displaced, while the metal objects drop into the collector. Metal objects collected in the collector can be transported to a container via a second conveyor.

13 Claims, 14 Drawing Sheets

SYSTEMS AND METHODS FOR SEPARATING METAL FROM RUBBER

CROSS REFERENCE TO RELATED APPLICATION

This application claims priority under 35 U.S.C. §119(e) to U.S. Provisional Patent Application No. 61/946,746, filed Mar. 1, 2014, entitled "SYSTEMS AND METHODS FOR SEPARATING METALS FROM RUBBER," which is hereby incorporated by reference in its entirety. Any and all priority claims identified in the Application Data Sheet, or any correction thereto, are hereby incorporated by reference under 37 CFR 1.57.

FIELD OF THE INVENTION

The present technology relates to mechanical separation of materials, particularly the separation of metals from non-metals. For example, systems are described that can be used to separate bullets from rubber or other backstop material at a shooting range.

DESCRIPTION OF THE RELATED ART

Shooting ranges include designated areas where people can go to discharge firearms in a safe and controlled environment. Many shooting ranges are outside, while others are indoors.

One measure of safety that ranges may take is to provide a backstop, towards which the participants fire their weapons, that provides a stopping place for the discharged ammunition. For instance, some shooting ranges have a backstop that comprises a pile of rubber pieces. Often a target of some kind is placed in between the participants and the backstop. Participants may fire their weapons in the direction of the target and the backstop. Once the weapon is discharged, the bullet or other projectile travels towards the backstop. One benefit of the backstop is that the bullet generally impacts the rubber pile and the kinetic energy of the bullet is absorbed by the backstop. The now motionless bullet may lie on the surface of the rubber pile or be lodged several inches into the pile. Over time, the rubber pile becomes more and more concentrated with the metal bullets. In some instances it may be impractical to simply replace the entire pile when it becomes saturated with metal bullets. Instead, one may choose to attempt to remove the metal bullets from the rubber pile. Therefore, a need exists for a system and a method to separate the metal bullets from the pile of rubber pieces.

SUMMARY OF THE INVENTION

The systems, methods, and devices of this disclosure each have several aspects, no single one of which is solely responsible for its desirable attributes. Without limiting the scope of this disclosure, certain prominent features will be discussed. After considering this discussion, and particularly after reading the section entitled "Detailed Description" one will understand how the features of this disclosure provide advantages over other separation systems.

Systems and methods for separating metallic objects from non-metallic objects are provided. In some embodiments, an apparatus for separating metallic objects from non-metallic objects includes a fan configured to blow forced air; and a conveyor configured to transport the metallic and non-metallic objects to a location above the fan. The conveyor is also configured to drop the metallic and non-metallic objects into the forced air blown by the fan. In some implementations, the apparatus includes a plurality of baffles disposed adjacent to the fan. The angle of each baffle relative to the fan can be set to create different layers of flow so that lighter materials a blown farther away from the fan than would otherwise occur. In some implementations, the apparatus includes a collector positioned to collect metallic objects after they are dropped into and displaced by the forced air.

Additional embodiments provide a system for sorting a mixture comprising a first plurality of objects and a second plurality of objects. Objects in the first plurality of objects have a mass greater than objects in the second plurality of objects. The system includes means for receiving the mixture, the receiving means conveying the mixture from a first end where the mixture is received into the system to a second end where the mixture falls off of the receiving means. The system also includes means for blowing forced air, the blowing means located below the receiving means such that forced air is directed at the mixture as it falls from the second end of the receiving means. The system further includes means for dividing the first plurality of objects from the second plurality of objects as the objects travel through the forced air from the blowing means.

In yet another embodiment, a method of separating metallic components from rubber components is provided. The method includes positioning a separation system near a source of a metal and rubber mixture, the metal and rubber mixture comprising at least metallic components and rubber components. The method also includes loading a first portion of the mixture onto at least a part of the separation system using a loading device. The method further includes subjecting the first portion of the mixture to moving air such that rubber components are laterally displaced away from the loading device a greater amount than metallic components are laterally displaced away from the loading device. The method also includes collecting the laterally-displaced metallic components in a collector.

According to some embodiments, a system can be provided for separating metallic objects from non-metallic backstop material at a shooting range. The system can comprise a fan, a plurality of baffles, a conveyor, and a divider. The fan can have an outlet and be configured to blow forced air out of the outlet. The plurality of baffles can be disposed adjacent the outlet of the fan. At least two of the baffles of the plurality of baffles can be positioned at different angles from each other with respect to the outlet of the fan to create at least two layers of air flow in the air forced out of the outlet. The conveyor can be positioned above the outlet of the fan and configured to transport metallic objects and non-metallic backstop material to a location above the outlet to drop the metallic and non-metallic objects into the forced air blown by the fan. The divider can be positioned adjacent the plurality of baffles to assist in separating the falling metallic objects and non-metallic backstop material, the majority of the metallic objects being heavier than the non-metallic backstop material. An angle of at least one of the divider and the plurality of baffles can be adjustable to further assist in separating the falling metallic objects and non-metallic backstop material.

Some systems may further comprise a ramped collector positioned between the plurality of baffles and the divider to collect the falling metallic objects and to direct them downward to a desired position with a sloped bottom surface. The ramped collector can comprise a first generally vertical side closest to the fan and a second generally vertical side furthest from the fan, wherein the divider is adjustably coupled to the second vertical side to allow for a plurality of positions angled from and including vertical. A second conveyer can be provided. The second conveyor can include a first end inclined relative to a second end, the first end of the second conveyor positioned at a bottom of the sloped bottom surface of the ramped collector and configured to receive metallic objects directed down the sloped bottom surface.

A partition and barrel can also be included in the system. The barrel can be positioned below the second end of the second conveyor to drop metallic objects into the barrel. The partition can be positioned to separate the fan, plurality of baffles, conveyor, divider, and ramped collector from the second conveyer and barrel. A hopper can be positioned above the conveyor to direct metallic objects and non-metallic backstop material onto the conveyor.

In some embodiments, the fan and plurality of baffles form a first unit and the conveyor forms a second unit, the first and second units being portable and sized to individually pass through a doorway. The first unit and second unit can be attachable and detachable and the conveyor can be angled upward by the first unit when attached.

In additional embodiments, at least three of the baffles of the plurality of baffles are positioned at different angles from each other with respect to the outlet of the fan to create at least three layers of air flow in the air forced out of the outlet.

According to some embodiments, a portable system can be provided for separating metallic objects from non-metallic backstop material at a shooting range configured for simple transport to and from a shooting range. The system can comprise a plurality of units, each unit sized to fit through a standard doorway. A first unit of the plurality of units can include a fan having an outlet and configured to blow forced air out of the outlet, and a plurality of baffles disposed adjacent to the outlet of the fan. At least two of the baffles of the plurality of baffles can be positioned at different angles from each other with respect to the outlet of the fan to create at least two layers of air flow in the air forced out of the outlet. A second unit of the plurality of units that is attachable and detachable to the first unit. The second unit can comprise a conveyor where the first unit is configured to incline the conveyor when the second unit is attached to the first unit such that the conveyor is positioned above the outlet of the fan and configured to transport metallic objects and non-metallic backstop material to a location above the outlet to drop the metallic and non-metallic objects into the forced air blown by the fan. A third unit of the plurality of units can comprise a divider. The divider can be configured to be positioned adjacent the plurality of baffles to assist in separating the falling metallic objects and non-metallic backstop material, the majority of the metallic objects being heavier than the non-metallic backstop material.

In some embodiments, the system can further comprise a plurality of wheeled platforms. There can be at least one wheeled platform per unit of the plurality of units, each unit configured for transport through a standard doorway on at least one wheeled platform of the plurality of wheeled platforms.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements.

DETAILED DESCRIPTION

Any feature or combination of features described herein are included within the scope of the present disclosure provided that the features included in any such combination are not mutually inconsistent as will be apparent from the context, this description, and the knowledge of one skilled in the art. In addition, any feature or combination of features may be specifically excluded from any embodiment of the present disclosure. For purposes of summarizing the present disclosure, certain aspects, advantages, and novel features of the present disclosure are described herein. Of course, not necessarily all such aspects, advantages, or features will be present in any particular embodiment of the present disclosure.

Embodiments presented herein are by way of example and not by way of limitation. The intent of the following detailed description, although discussing exemplary embodiments, is to be construed to cover all modifications, alternatives, and equivalents of the embodiments as may fall within the spirit and scope of the disclosure.

Figure 1:
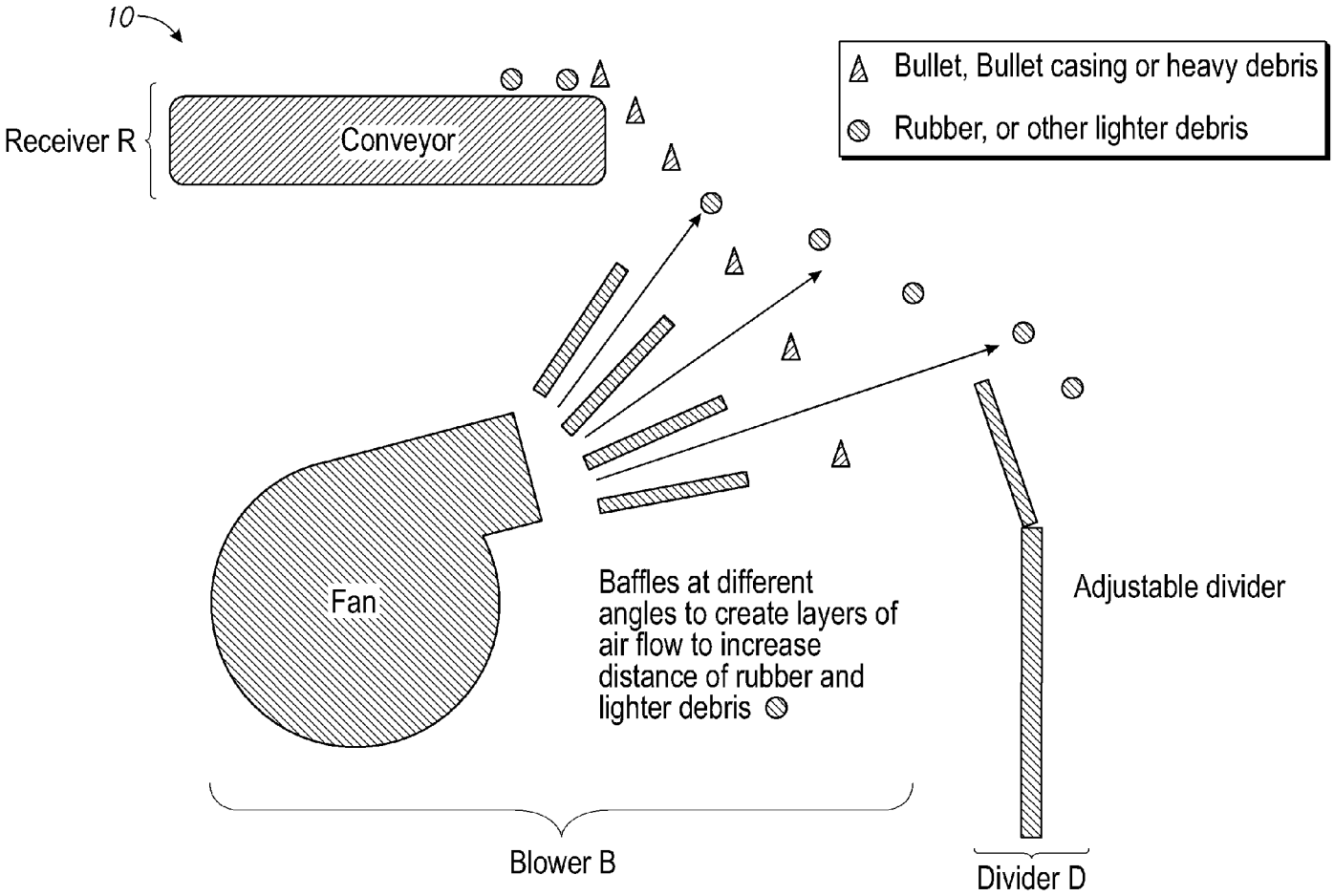
FIG. 1 illustrates a schematic view of an embodiment of a system for separating heavy pieces, such as metal bullets, from lighter pieces, such as rubber debris.

System for Separating Heavy Debris, Such as Metal, from Lighter Debris, Such as Rubber FIG. 1 illustrates a side view of parts of a system 10 to separate heavy pieces from lighter pieces (pieces generally having less mass than the heavy pieces), according to one embodiment of the present disclosure. In some implementations, the heavy pieces include generally metallic objects or debris, such as bullets, pellets, BBs, and/or bullet casings, and the lighter pieces generally include non-metallic objects, such as rubber pieces or rubber debris.

The system 10 includes a receiver R, a blower B, and a divider D. In general, the receiver R accepts a mixture of objects to be separated into the system and introduces the mixture into a position or location within the system where the blower B directs air at the mixture. For example, the mixture is dropped in front of the blower B in some cases. The forced air from the blower B can have different effects on the falling mixture, depending on the properties of the pieces in the mixture. For example, the heavy pieces generally travel a shorter distance, due to their greater mass, than the lighter pieces when the force of air from the blower B is directed at the falling mixture. The effect may be that once the heavy and lighter pieces have fallen to the ground (or into a collector on the ground), the fallen heavy pieces are generally located in a first area (closer to the blower B) and the fallen lighter pieces are generally located in a second area (further away from the blower B than the first area). In some cases, the heavier pieces drop into a collector (not shown in FIG. 1), while the lighter pieces are laterally displaced a greater distance from the blower B than the heavy pieces and generally do not fall within the collector.

The divider D helps separate the falling heavy pieces from the falling lighter pieces, and in some implementations can assist in gathering and/or collecting the fallen, now-separated heavy pieces. As will be described in greater detail below, the system 10 can include additional features configured to move the now-separated heavy pieces to a collection area for removal from the system 10.

In the embodiment illustrated in FIG. 1, the receiver R includes a conveyor configured to receive a mixture of heavy pieces and lighter pieces into the system 10 for separation. The conveyor can be oriented generally horizontally, as shown in FIG. 1, and move the mixture along a generally horizontal path within the system toward the blower B. In other implementations described below, the conveyor can be oriented at an angle and move the mixture along an inclined path toward the blower B. In this embodiment, the conveyer delivers the mixture of heavy objects and lighter objects to an area of the system 10 where air from blower B acts on the mixture delivered by the conveyor. In this example, the mixture is dropped in front of the blower B when it falls off of the conveyor. The blower B is a machine for producing airflow, such as a fan. In this embodiment, the mixture of objects fall from the conveyor into an area within system 10 where air from the fan is directed. The force of the air acting on the falling mixture of objects causes the objects to travel a different path (or be laterally displaced) than if no air had been applied as the objects were falling. The paths of the lighter objects are generally different than the paths of the heavy debris because of the different material properties of the objects. For example, the lighter objects can be laterally displaced to a first area and the heavy objects can be laterally displaced to a second area, where the second area is generally closer to the fan than the first area. As will be described in detail below, the fan may include structures configured to alter and/or optimize the difference in the paths traveled by the heavy objects and the lighter objects. In some cases, the fan includes baffles at different angles to create layers of air flow to increase the lateral distance the lighter debris travels, as compared to the lateral distance the heavy debris travels.

The system 10 according to this implementation also includes a divider D configured to aid in dividing the heavy objects from the lighter objects as they travel through the system 10 under the influence of air from the blower B. Divider D can include an adjustable divider having a first portion including a fixed generally vertical wall, and a second portion adjustably coupled to the first portion at a non-vertical angle. The second portion may be coupled to the first portion with a hinge, for example, and can be adjusted while the system 10 is separating objects to take into account the particular characteristics of, and the particular paths of, the objects as they are blown by the air and separated. The divider D can assist in separating and collecting objects as they fall or after they have already fallen and are no longer traveling in the air. For example, heavy objects traveling through the air may collide with the left-most face of the adjustable divider and be directed back toward the fan, in a direction generally away from an area where lighter objects are falling and being collected. The adjustable divider may also couple to and interact with other features of the system 10, described in detail below, that transport heavy debris (after it has fallen and is already separated) away from the blower B and the divider D for removal from the system 10.

It will be understood that in some embodiments, the relationship between the blower outlet and the baffles can also be adjustable. The baffles can be individually adjustable, or collectively adjustable. This can provide additional functionality similar to the adjustable divider and may be used instead of, or in addition to, an adjustable divider.

Implementations of the system 10 can separate a first kind of object "M" that is wholly or predominately made of metal materials, such as bullets and bullet casings, from a second kind of object "R" that is not wholly or predominately made of non-metallic materials, such as pellets of rubber or other non-metallic materials. Persons of skill in the art will understand, however, that the system 10 can separate objects that are not entirely formed of metal materials from objects that are not entirely formed of rubber materials. For example, in some implementations, object "M" can include metal as well as other types of materials, such as plastic, rubber, and/or glass, and object "R" can include rubber as well as other types of materials, such as metal, plastic, and/or glass. Further, embodiments of the system 10 are not limited to separating metal objects from non-metallic objects. In some cases, the system 10 can separate objects formed of a first material from objects formed of a second material, where the first material is generally heavier than the second material. Persons of skill in the art will also understand that the system 10 can separate a mixture of objects "M" from a mixture of objects "R" even in situations where all objects "M" do not have more mass than (are not heavier than) all objects "R". In some cases, for example, the system 10 will separate a mixture of objects where the average weight of objects "M" is greater than the average weight of objects "R".

FIGS. 2-7 illustrate at least a portion of one or more embodiments of a separator. The separator will be described with reference to the separation of metal bullets from rubber, though it will be understood that the separator can also be used for other purposes. As shown in the illustrated embodiment, the separator may comprise a first conveyor 100, a blower or fan 200, a collector 250, a discharge area 300, and a second conveyor 350. The mixture of rubber and metal may be loaded onto the first conveyor 100 where it is dropped in front of the blower 200. The blower 200 may force air at the rubber and metal mixture, wherein due to the differing physical properties of the two materials, the rubber may be laterally displaced, while the metal drops into a collector 250. The metal in the collector 250 may be transported to a container (not shown) via a second conveyor 350. In some embodiments, only a single conveyor is used.

In some embodiments, a hopper 105 may be used to help distribute a metal and rubber mixture onto the first conveyor 100. The hopper 105 may comprise metal or plastic or some other material. The hopper may have at least two openings. The first opening 110 may be larger than the second opening 115, and may be configured to accept the metal and rubber mixture. The first opening 110 may be several feet wide, such that a user may be able to shovel the mixture into the hopper 105. The second opening 115 of the hopper 105 may be disposed adjacent or above at least part of the first conveyor 100. The second opening 115 may be configured to distribute a metal and rubber mixture from the hopper 105 onto the conveyor 100. The second opening 115 may be configured to allow a generally specified amount of the mixture to go through the opening at a time. Other methods may be employed to distribute a metal and rubber mixture onto the first conveyor 100.

The first conveyor 100 may comprise a conveyor belt 120, a support structure 125, and a motor 130. In some embodiments, the first end of the conveyor 135 is located near ground level adjacent at least part of the hopper 105. The second end of the conveyor 140 may be located several feet away from the first end, and may be elevated several feet in the air. In some embodiments the second end 140 is between 1 and 7 feet in the air, or between 2 and 5 feet in the air, or the second end of the conveyor 140 maybe approximately 3 to 4 feet high. The conveyor belt 120 may comprise one or more cleats 145 that may help prevent the mixture from sliding back down the conveyor belt 120. The belt 120 may comprise rubber, metal, plastic, nylon, or other various materials, and may be several inches wide. The belt may travel up the first conveyor 100, around a first roller, then back down the underside of the conveyor 100, around a second roller, and then up the conveyor again. In some embodiments, other methods may be used to transport the mixture. The hopper and conveyor can be positioned to evenly distribute the material on the conveyor.

The first conveyor 100 may further comprise a support structure 125 designed to support the belt and other components. The support structure 125 may comprise metal or other structurally suitable materials. A stand 155 may be disposed under at least part of the first conveyor 100 that may help keep the second end of the conveyor 140 elevated above the ground. The stand 155 may be integral to the first conveyor 100 or may be attachable by a user. The first conveyor 100 may further comprise a motor 130 and a controller 160, from which the operation of the conveyor 100 is controlled. The motor 130 may be operatively connected to the belt 120 such that the operation of the motor 130 may drive the operation of the belt 120. The motor 130 may be powered by various power supplies including 110V power. Other power sources may be suitable depending on the size and specific requirements of the motor used.

The metal and rubber mixture may occasionally fall off of the conveyor belt 120. In some instances, some of the mixture may travel to a space beneath the conveyor belt 120, in the interior of part of the first conveyor 100. In some embodiments, the support structure 125 of the first conveyor 100 may define openings (not shown) beneath the conveyor belt 120. The openings may be configured to allow any mixture that has become displaced from the conveyor belt 120, to fall out of the conveyor 100 on the other side. Since part of the mixture may be metal, any metal pieces that become lodged in the conveyor 100 may cause damage to different parts of the conveyor 100. Therefore, parts of the conveyor 100 may be configured to prevent metal or other parts of the mixture from becoming stuck. For example, the conveyor can have a plurality of holes in the bed, to allow material to fall through the conveyor that has fallen off the belt.

A blower 200 may be disposed under or adjacent at least part of the first conveyor 100 and may be part of the first conveyor 100 assembly. The blower 200 may comprise a fan (not shown) that is configured to force air through an opening. The opening may be covered with a screen 205 or other feature to prevent objects from entering the fan area. The blower 200 may be disposed such that the forced air travels in a generally upward direction away from the blower 200 and away from the first end of the first conveyor 135. As parts of the metal and rubber mixture are brought to the second end of the conveyor 140 by the conveyor belt 120, the mixture may fall or be forced off of the belt 120 near the second end of the conveyor 140. As the mixture falls from the conveyor 100, it may travel in front of at least part of the blower 200 and through the air forced by the blower 200. Due to the different physical characteristics of the components of the mixture, the forced air may have different effects on the falling mixture. For instance, in some embodiments, metal in the mixture may be denser than rubber in the mixture. Therefore, when the same velocity air hits the metal and the rubber, the rubber may be displaced further laterally than the metal. The effect may be that once the metal and rubber fall to the ground, the metal may generally be located closer to the blower 200 than the rubber.

The blower 200 may comprise an industrial fan and may be several inches in diameter. In some embodiments the diameter of the blower 200 may be between 6 and 36 inches in diameter; or between 10 and 24 inches in diameter; or approximately 18 inches in diameter. The blower 200 may comprise a plurality of fans in parallel or in series. The blower 200 may generally blow air in an upward direction, which may be accomplished by angling the blower 200 above horizontal. The blower 200 may be operatively connected to the controller 160, such that modifying a parameter on the controller 160 affects an operation of the blower 200.

In some embodiments, baffles 210 are disposed adjacent the blower 200 and help direct the air to the proper angle. The baffles 210 may comprise metal, plastic, wood, or other suitable material. The baffles 210 may be generally disposed in front of the area through which the blower 200 forces air. The baffles 210 may be adjustable or removable in order to modify the system as needed. Or, the baffles 210 may be permanently attached to a portion of the blower 200, or other part of the system. In some embodiments, three baffles 210 are permanently attached to a portion of the blower 200, and the baffles 210 help direct the air in a generally upward direction. The forced air may travel in a direction between 0 degrees and 90 degrees relative to horizontal; or between 20 degrees and 70 degrees; or at approximately 45 degrees relative to horizontal. The baffles 210 may be spaced several inches apart in order to adequately direct the air. More or less distance between the baffles 210 may be necessary depending on the configuration of the system.

The metal falling from the first conveyor 100 and through the layer of forced air, may land in a collector 250, which may be disposed adjacent the blower 200. The collector 250 may have one or more sides that helps keep the metal in a designated area. In some embodiments, the collector 250 comprises a structure with at least two sides, a first side closest to the blower 255, and a second side furthest from the blower 260. The collector 250 may comprise a third and fourth side, or may leave those sides generally open. The bottom of the collector 265 may be sloped such that the metal falling into the collector 250 is directed towards one side of the collector 250. In some implementations, the metal falling into the collector 250 is directed towards the side of the collector closest to partition 305.

On or near the top of the second side 260 may be disposed a divider 270. In some embodiments the divider 270 is adjustably attached to the top of the second side 260 such that the top of the divider 270 may be disposed in a plurality of positions. The divider 270 may be configured such that the top of the divider 270 is located in a position that helps separate the falling metal from the falling rubber. Since the rubber may be laterally displaced by a different amount that the metal, one may dispose the top of the divider 270 such that the rubber generally falls on one side of the divider 270 and the metal falls on the other side. This may help the separation process by being able to adjust a parameter of the process. By being able to adjust a parameter of the process, the overall efficiency of the system may be improved. The divider 270 may be adjusted in other ways as well. For instance, in some embodiments, the height of the divider 270 may be adjusted, or the location along the divider 270 or the collector 250 at which the divider 270 attaches may be adjusted.

Once the rubber pieces are laterally displaced away from the blower 200 and generally away from the metal pieces, the rubber pieces may travel to a rubber discharge area 300. The rubber discharge area 300 may comprise a container or may comprise an area in which the rubber lands. From there, the rubber may be transported back to the backstop rubber pile as much of the metal may have been removed from the metal and rubber mixture.

In some embodiments, the system may comprise a second collector (not shown). The metal in the mixture may not always land in the collector 250 and may, in some instances, be displaced laterally further than the divider 270. In some embodiments, a second collector may be displaced between the collector 250 and the rubber discharge area 300. The parts of the metal and rubber mixture that land in the second collector may be added to the first collector 250, to the rubber discharge area 300, to the backstop rubber pile, or may be added to the first conveyor 100 to be subject to the forced air at least a second time. The necessity of a second container may be influenced, at least in part, by the rubber to metal ratio in the collector 250, and the rubber to metal ratio in the rubber discharge area 300. If the first ratio is sufficiently low, and/or the second ratio is sufficiently high, then a second collector may not be necessary.

Figure 2:
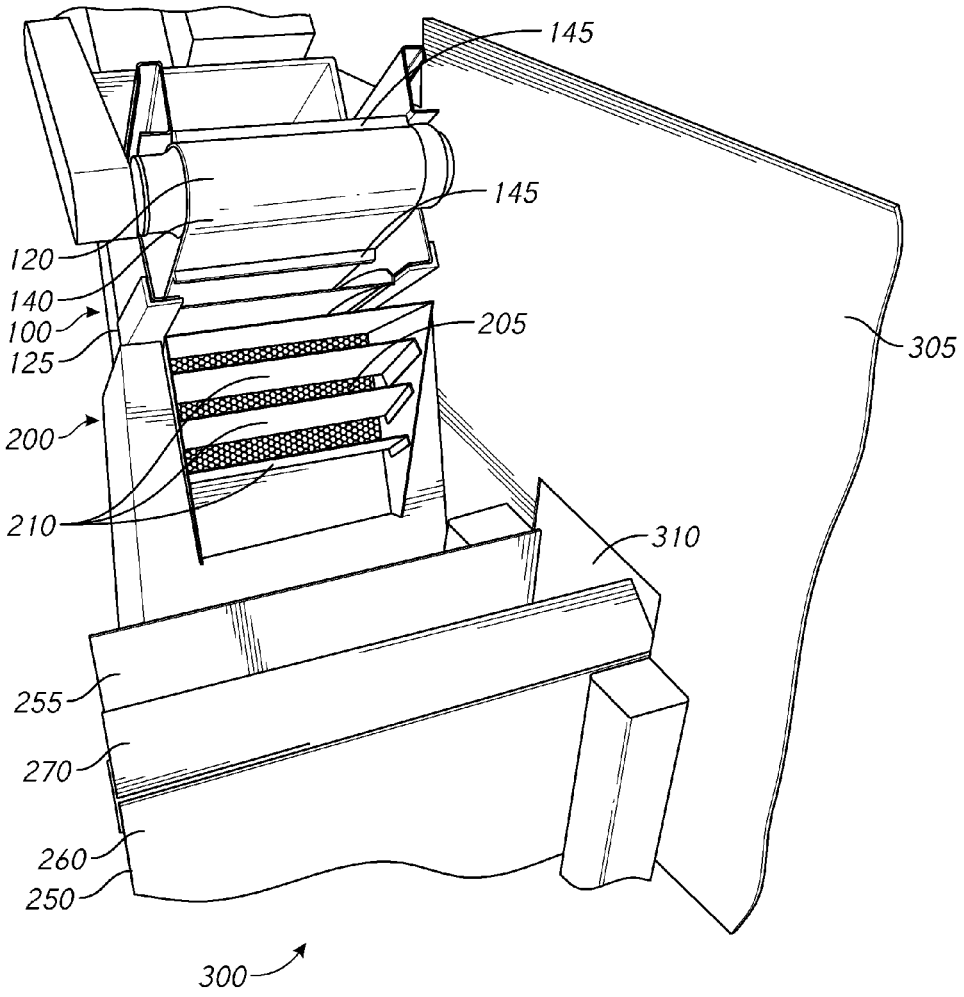
FIG. 2 illustrates a front perspective view of an embodiment of a separator device.
Figure 3:
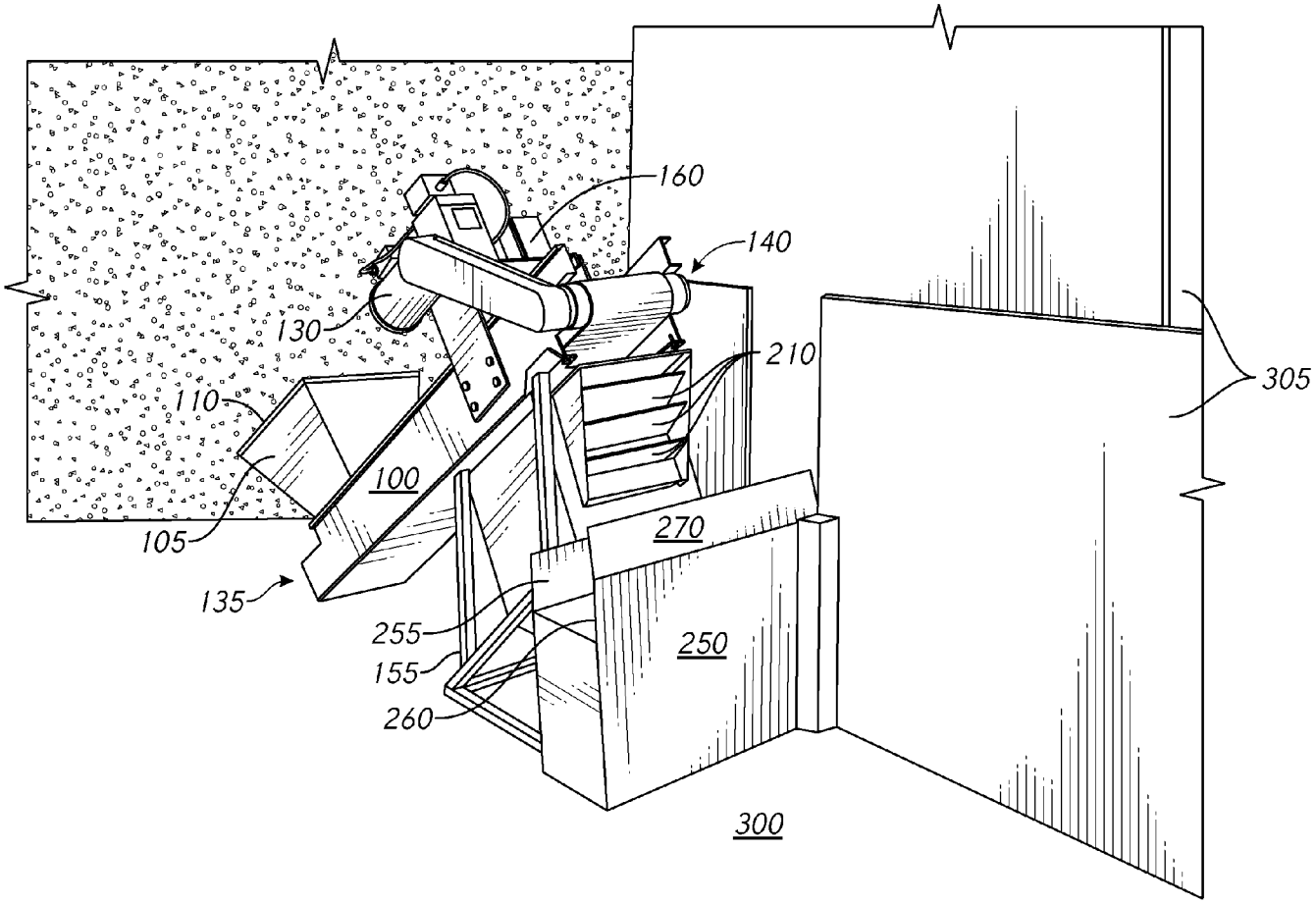
FIG. 3 illustrates a front perspective view of an embodiment of a separator device.
Figure 4:
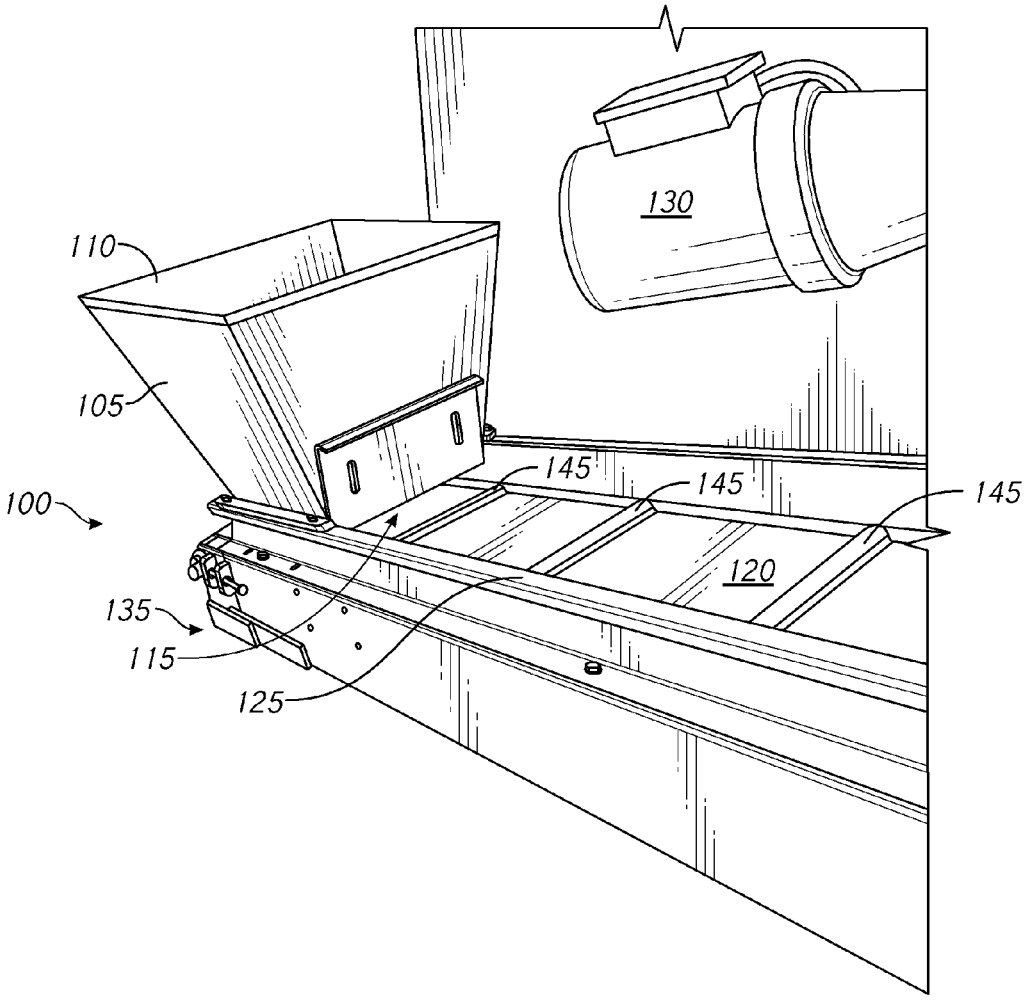
FIG. 4 illustrates at least a top perspective view of a hopper and a conveyor.
Figure 5:
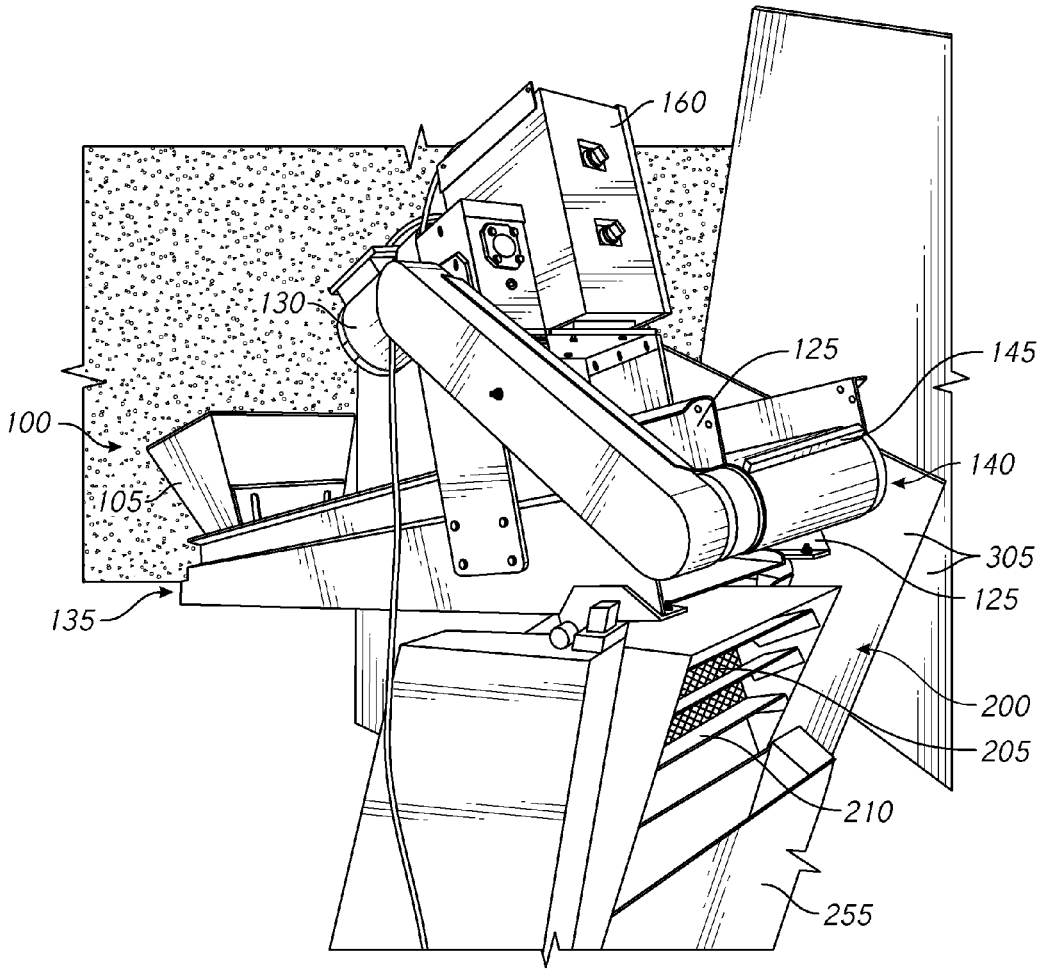
FIG. 5 illustrates a front perspective view of at least a conveyor and a blower.
Figure 6:
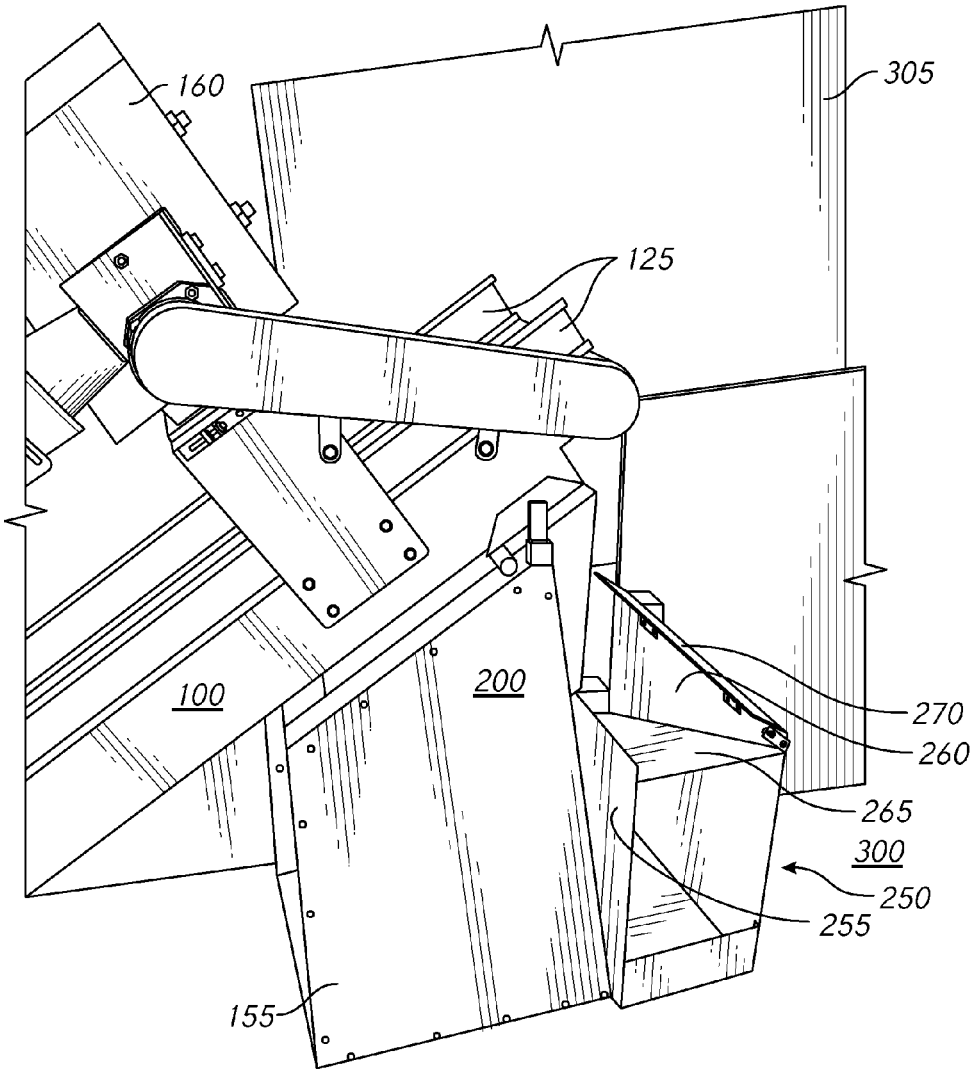
FIG. 6 illustrates a side view of at least a conveyor, a blower, and a collector.
Figure 7:
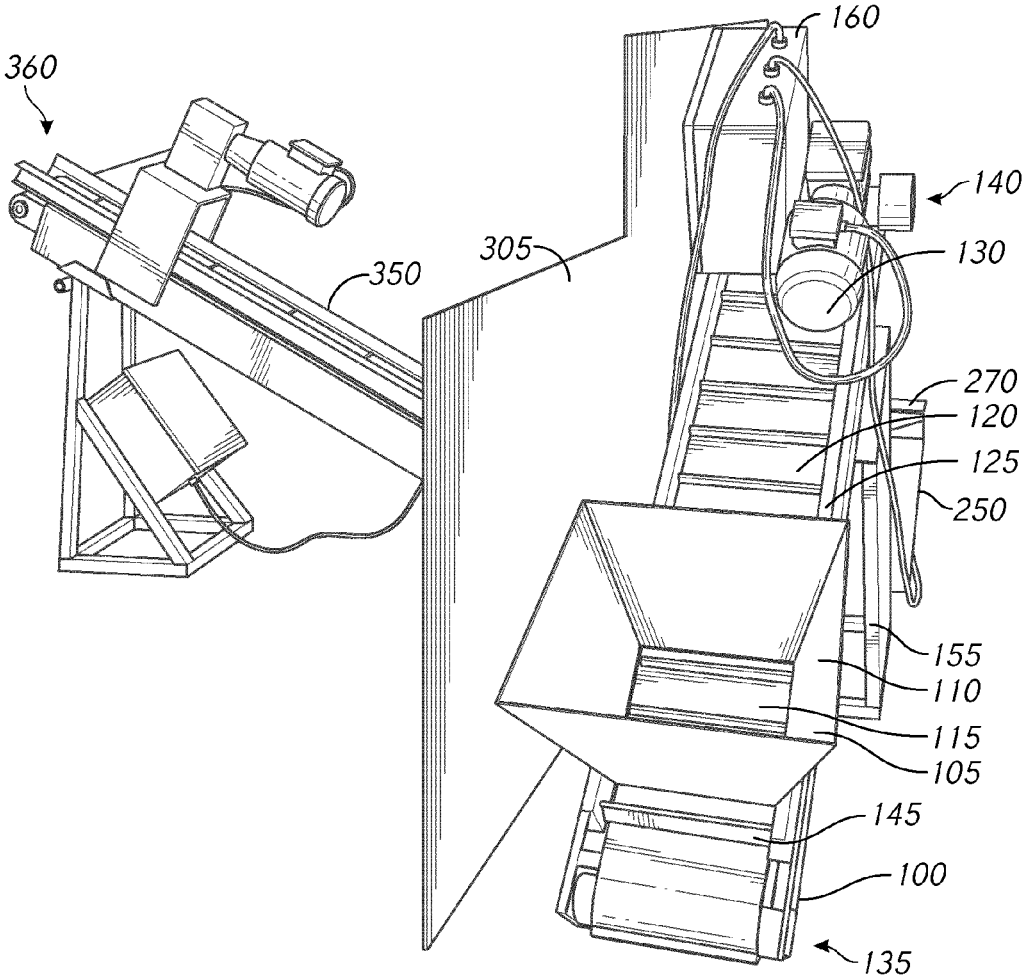
FIG. 7 illustrates a rear perspective view of an embodiment of a separator device.
Figure 8:
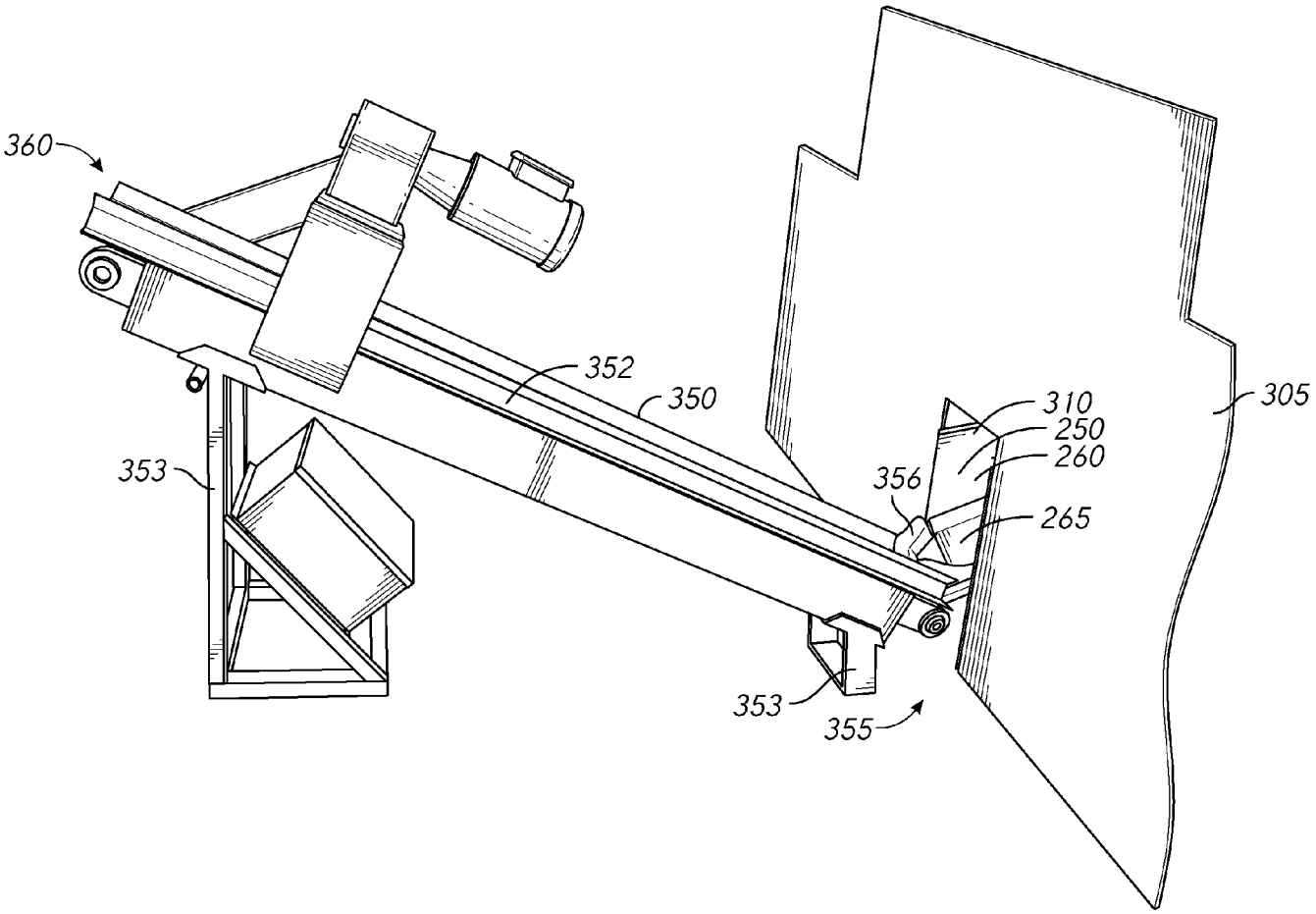
FIG. 8 illustrates a side perspective view of at least a part of an embodiment of a separator device.
Figure 9:
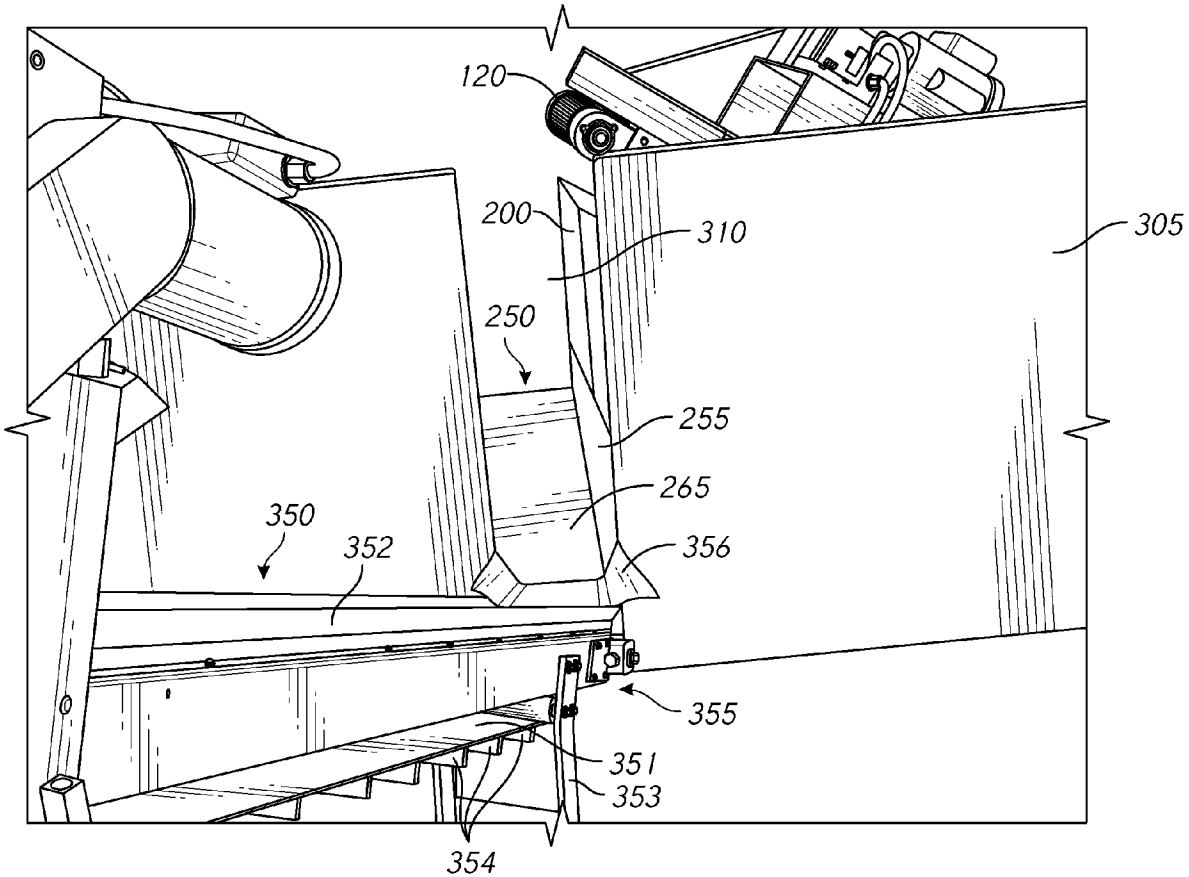
FIG. 9 illustrates a side view of at least a partition and a second conveyor.
Figure 10:
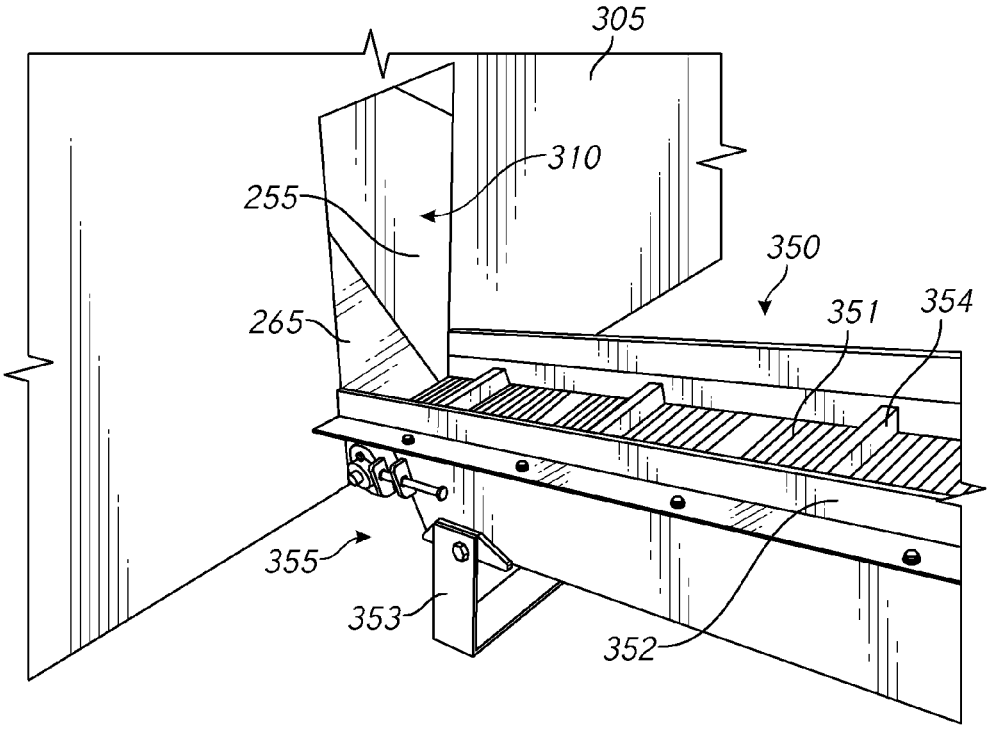
FIG. 10 illustrates a side view of at least a partition and a second conveyor.
Figure 11:
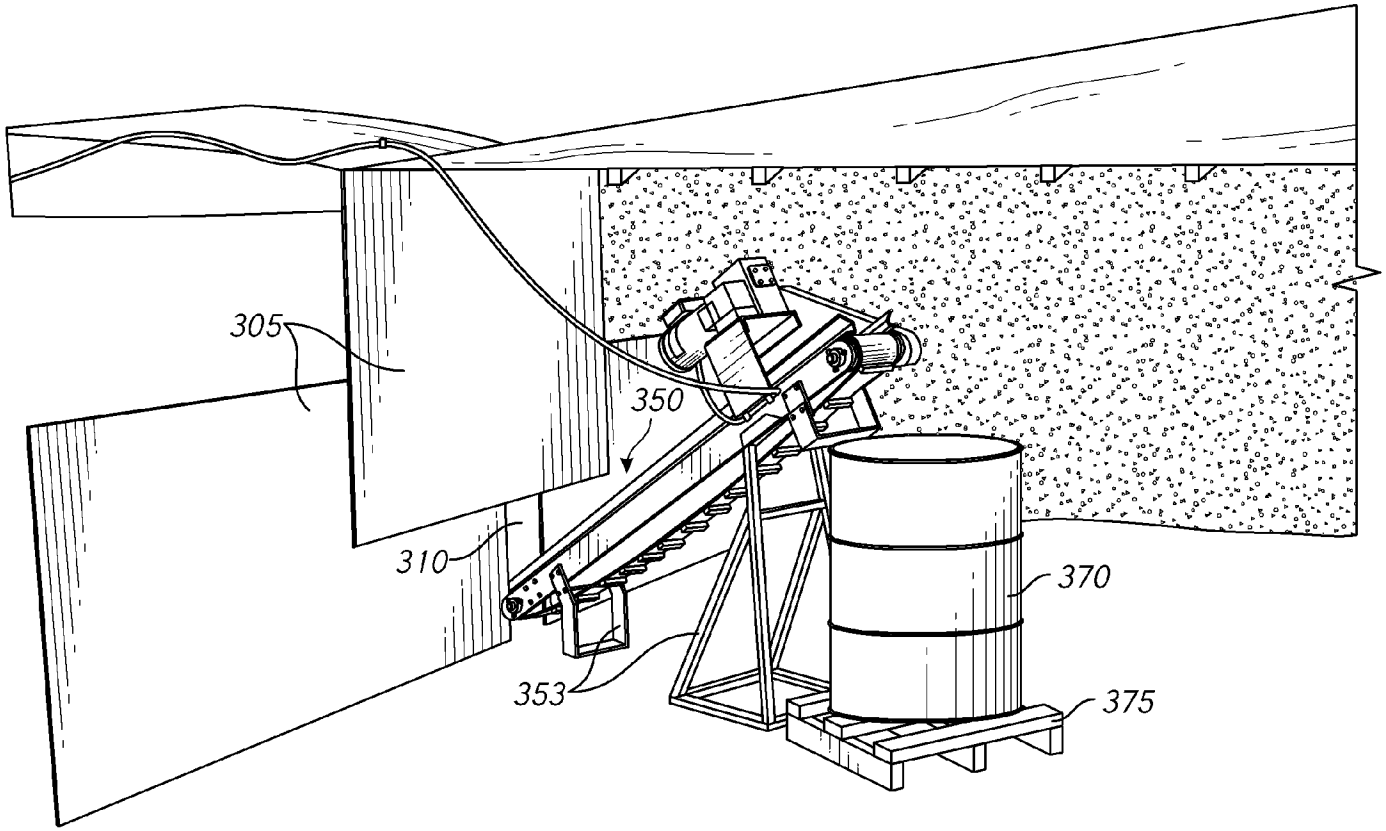
FIG. 11 illustrates a front perspective view of at least a partition and a second conveyor.

As shown in FIGS. 7-11, in some embodiments a partition 305 may be disposed adjacent the first conveyor 100 and in a direction generally parallel to the direction of the forced air. The partition 305 may comprise wood, metal, cardboard, or another sufficiently stable material. The partition 305 may be several feet high and several feet long. The partition may be formed of a single piece of material, as shown in FIG. 2, or formed of multiple pieces of material coupled together to form a generally vertical wall, as shown in FIG. 3. In some embodiments the purpose of the partition 305 may be to help contain the rubber being laterally displaced from landing in certain areas. The partition 305 may provide other benefits as well. In some embodiments, the partition 305 defines an opening 310 located adjacent the collector 250. The metal that falls into the collector 250 may be directed towards one side of the collector 250 on an angled floor 265. The partition 305 may be configured to allow access to the metal in the container 250.

A first end of a second conveyor 355 may be located adjacent the opening in the partition 310. The second conveyor 350 may be configured to help transport the metal pieces from the collector 250 into a container 370. In some examples, the container 370 collects the now-sorted metal pieces and is used to transport the metal pieces away from the separator. The second conveyer 350 can include a conveyor belt 351, a support structure 352, and a stand 353. The metal pieces may be placed on the first end of the conveyor 355 by a user, by gravity, or by some other active or passive means. The metal may be transported away from the collector 250 and towards a container, such as container 370, on a belt of the second conveyor 350. The second end of the conveyor 360 may be several feet away from the first end, and may be further from the ground than the first end of the conveyor 355. The conveyor belt 351 may include cleats 354 configured to prevent the metal pieces from sliding back down the conveyor belt 351 as they travel from the first end of the second conveyer 355 toward the second end of the second conveyor 360. Configuring the second end of the second conveyor 360 may help transport the metal pieces into the container 370. In some embodiments, the second end of the second conveyor 360 is disposed at least partially above an opening in the container 370 such that when the metal pieces fall off of the end of the second conveyor 360, they fall into the container 370. In other configurations, the second conveyor 350 may not be necessary and the metal pieces in the collector 250 are transported directly to a container.

In some implementations, movement of metal pieces from the collector 250 to the second conveyor 350 is facilitated using a funnel coupling the angled floor 265 to the conveyor belt 351. In the example illustrated in FIGS. 8 and 9, the funnel includes a sheet 356 configure to funnel metal pieces traveling down the angled floor 265 onto the conveyor belt 351. The sheet 356 can include a flexible material comprising rubber or plastic. In some embodiments, such as that shown in FIG. 10, the second conveyor 350 does not include a sheet 356 and metal pieces are transported directly from angled floor 265 onto the conveyor belt 351.

In some embodiments the container 370 is a 55-gallon drum, and may be located on a base 375. The base may be configured to engage with a container-moving device such as a pallet jack or forklift. The pallet jack may engage the base, on which the container 370 is located, and move the base away from the second conveyor 350.

Figure 12:
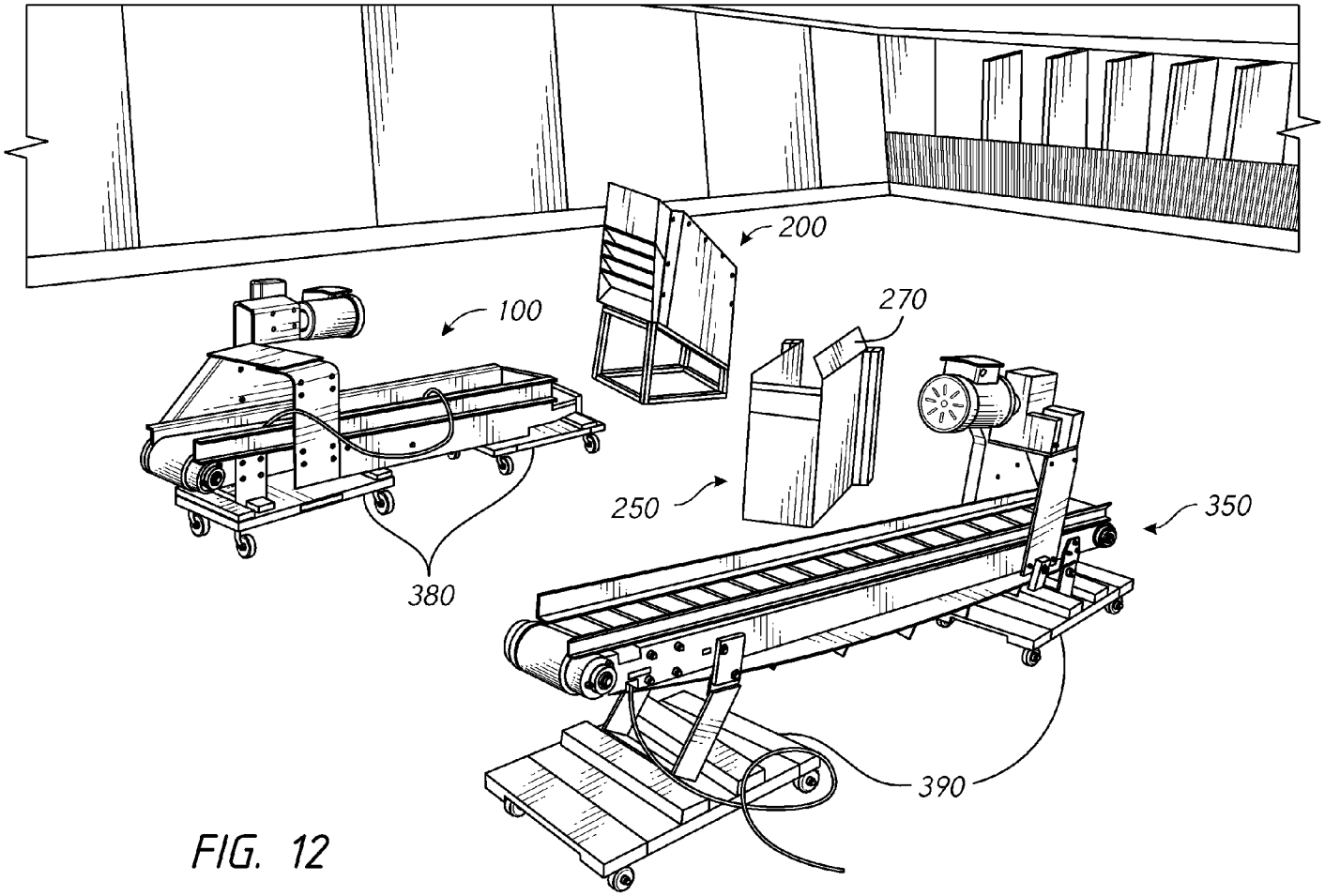
FIG. 12 illustrates a side perspective view of parts of a system to separate metal from rubber.
Figure 13:
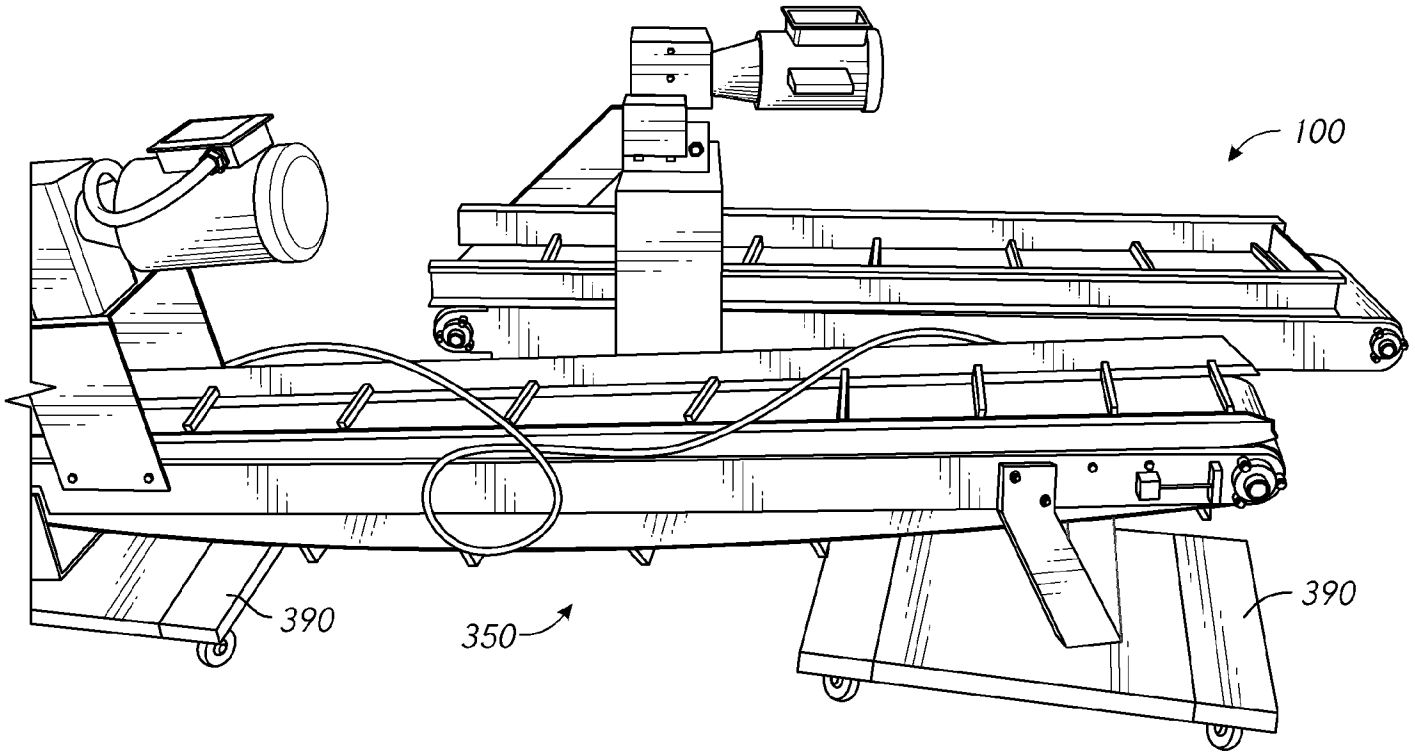
FIG. 13 illustrates a side view of parts of a system to separate metal from rubber.
Figure 14:
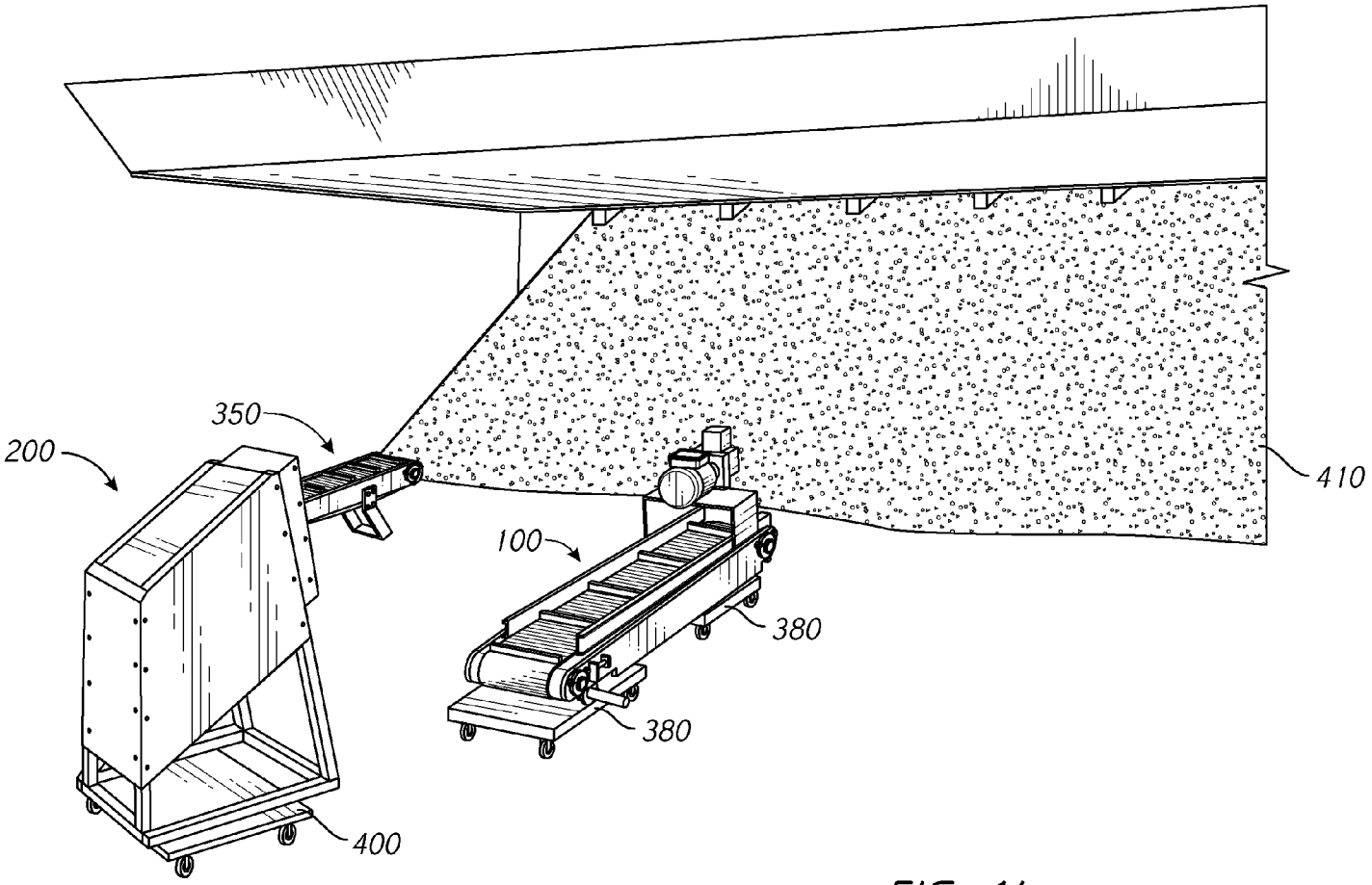
FIG. 14 illustrates a side view of parts of a system to separate metal from rubber near a pile of metal and rubber mixture.

As shown in FIGS. 12-14, the metal and rubber separation system may comprise several sections. Because the equipment may be transported to each individual shooting range, the equipment may be configured to accommodate the different geometries of the different shooting ranges. Shooting ranges may comprise a variety of obstacles when it comes to moving equipment into and out of the shooting area (where the rubber pile is often located). For instance, shooting ranges often have a wire pulley system associated with each individual shooting stall. The wire pulley system may be used to attach a target, which may then be transported towards the backstop rubber pile, such as backstop rubber pile 410 illustrated in FIG. 14. The wire pulley system may be attached to a generally low ceiling. Thus, both the low ceiling and the wire pulley system may be obstacles around which a user may need to navigate the equipment during transport, assembly, use, and disassembly.

In some embodiments the first conveyor 100 comprises a first section that can be placed on one or more wheeled platforms 380, the second conveyor 350 may comprise a second section that can be placed on one or more wheeled platforms 390, and the blower 200 can comprise a third section that can be placed on a wheeled platform 400, as shown in FIGS. 12-14. The wheeled platforms may be configured to move heavy objects like furniture and may be able to withstand significant loads. The first conveyor 100 may be several feet long and may benefit from the support of two wheeled platforms. However, navigating the first conveyor 100 on one or more wheeled platforms may be difficult given the other obstacles that could be present. For instance, some shooting ranges are equipped with sets of doors that may only allow one of the two doors open at a single time. Or, even if the two doors can be opened at the same time, the doorways may not align in a way that would easily facilitate transporting a conveyor and blower assembly on a plurality of wheeled platforms. Thus, it may be necessary or beneficial for the system to be configured such that each section could be at least partially adjusted into a more vertical position. In some embodiments, the hopper is not permanently attached to the first conveyor 100, and at least part of the support structure of the first or second conveyor 100, 350 may be detachable for transport to or from a location.

Each component of the system can pass through a standard doorway. As shown, each group of components on the wheeled platforms can pass through a standard doorway. In addition, the components on the wheeled platforms can be stood end on end if necessary to pass through an 8 feet by 8 feet space between two doors. In some embodiments, the system to separate metal and rubber may be transported to the shooting range location as it may be impractical to bring the metal and rubber mixture to a central location. The system may comprise one or more segments which may be assembled at the location. A standard doorway can be 80 inches by 36 inches.

The size and power of the blower 200 may be altered to provide more or less forced air through the metal and rubber mixture; or more than one fan may be used as a blower 200. The number, size, and orientation of the baffles 210 may be modified in order to get the forced air to travel in the direction desired. In some embodiments, it may be beneficial to have more or less air being forced out of the top of the blower 200 as compared to the bottom of the blower 200. Or, it may be beneficial to have the air traveling out of the top of the blower 200 to be directed at a different angle relative to the air traveling out of the bottom of the blower 200. Different sizes and orientations of the baffles 210 may help alter some of these parameters to best suit the specific situation. Other adjustments may be made as well.

Using forced air to separate metal from rubber falling off a conveyor belt as a means to remove metal from a backstop rubber pile may have several benefits. First, the equipment necessary to perform the separation is transportable in a plurality of sections, which may allow the equipment to go into smaller or more compact shooting ranges. Second, since the divider 270 may be adjustable, the process can be modified depending on the specific conditions of the shooting range and the parameters of the rubber pile. Some piles may have rubber pieces that are very large, or very small, and the exact position of the divider 270 may be at least partially influenced by the size of the rubber pieces.

Finally, because this process is easily set up and is easily modified, a rubber pile for a shooting range may be substantially removed of metal in a single night, whereas conventional methods may take several days. This process is performed in the shooting area where people are usually discharging their weapons. Therefore, this can usually only be done when there are no people using the shooting facilities. This normally requires the owner to shut down his business for several days and can result in lost revenues. Using forced air to separate metal from the metal and rubber mixture may allow a business owner to shut down his shooting range for a single night and in some instances, may not need to disrupt his regular business hours.

Methods to Separate Metal from Rubber

In some embodiments, a method to separate metal from rubber may include some or all of the following steps: positioning a separation system near a source of a metal and rubber mixture; wherein the metal and rubber mixture comprises at least metal and rubber components; loading the mixture onto at least part of the system using a system-loading device; subjecting the mixture to moving air such that the rubber components are laterally displaced to a different amount than the metal components are displaced; collecting the metal components in a collector and transporting the metal components to a container; collecting the rubber components. The source of the metal and rubber mixture may comprise a shooting range. The system-loading device may comprise a hopper and/or a conveyor. The method may further comprise using a blower as a source of the moving air. The method may further comprise dropping the mixture from a conveyor in front of a blower. The method may further comprise using a second conveyor to transport the metal into the container. The method may further comprise using a 55-gallon drum as the container. The method may further comprise returning the rubber components from the rubber mixture to the shooting range.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A system for separating metallic objects from non-metallic backstop material at a shooting range, the system comprising:

a fan having an outlet and configured to blow forced air out of the outlet;

a plurality of baffles disposed adjacent to the outlet of the fan, wherein at least two of the baffles of the plurality of baffles are positioned at different angles from each other with respect to the outlet of the fan to create at least two layers of air flow in the air forced out of the outlet;

a conveyor positioned above the outlet of the fan and configured to transport metallic objects and non-metallic backstop material to a location above the outlet to drop the metallic and non-metallic objects into the forced air blown by the fan;

a divider positioned adjacent the plurality of baffles to assist in separating the falling metallic objects and non-metallic backstop material, the majority of the metallic objects being heavier than the non-metallic backstop material;

wherein an angle of the divider is adjustable to further assist in separating the falling metallic objects and non-metallic backstop material;

a ramped collector positioned between the plurality of baffles and the divider to collect the falling metallic objects and to direct them downward to a desired position with a sloped bottom surface, the ramped collector comprising a first generally vertical side closest to the fan and a second generally vertical side furthest from the fan and wherein the divider is adjustably coupled to the second vertical side to allow for a plurality of positions angled from and including vertical; and a second conveyer including a first end inclined relative to a second end, the first end of the second conveyor positioned at a bottom of the sloped bottom surface of the ramped collector and configured to receive metallic objects directed down the sloped bottom surface.

2. The system of claim 1, further comprising a barrel, the barrel positioned below the second end of the second conveyor and the second conveyer configured to drop metallic objects into the barrel.

3. The system of claim 2, further comprising a partition, the partition positioned to separate the fan, plurality of baffles, conveyor, divider, and ramped collector from the second conveyer and barrel.

4. The system of claim 1, further comprising a hopper positioned above the conveyor to direct metallic objects and non-metallic backstop material onto the conveyor.

5. The system of claim 1, wherein the fan and plurality of baffles form a first unit and the conveyor forms a second unit, the first and second units being portable and sized to individually pass through a doorway.

6. The system of claim 5, wherein the first unit and second unit are attachable and detachable and the conveyor being angled upward by the first unit when attached.

7. The system of claim 1, wherein at least three of the baffles of the plurality of baffles are positioned at different angles from each other with respect to the outlet of the fan to create at least three layers of air flow in the air forced out of the outlet.

8. A portable system for separating metallic objects from non-metallic backstop material at a shooting range configured for simple transport to and from a shooting range, the system comprising:

a plurality of units, each unit sized to fit through a standard doorway;

a first unit of the plurality of units comprising:

a fan having an outlet and configured to blow forced air out of the outlet; and a plurality of baffles disposed adjacent to the outlet of the fan, wherein at least two of the baffles of the plurality of baffles are positioned at different angles from each other with respect to the outlet of the fan to create at least two layers of air flow in the air forced out of the outlet;

a second unit of the plurality of units that is attachable and detachable to the first unit, the second unit comprising:

a conveyor, the first unit configured to incline the conveyor when the second unit is attached to the first unit such that the conveyor is positioned above the outlet of the fan and configured to transport metallic objects and non-metallic backstop material to a location above the outlet to drop the metallic and non-metallic objects into the forced air blown by the fan;

a third unit of the plurality of units comprising a divider, the divider configured to be positioned adjacent the plurality of baffles to assist in separating the falling metallic objects and non-metallic backstop material, the majority of the metallic objects being heavier than the non-metallic backstop material, the third unit further comprising a ramped collector configured to collect falling metallic objects and to direct them downward to a desired position with a sloped bottom surface, wherein the ramped collector comprises a first generally vertical side and a second generally vertical side, wherein a divider is adjustably coupled to the second vertical side to allow for a plurality of positions angled from and including vertical; and a fourth unit of the plurality of units comprising second conveyer including a first end configured to be inclined relative to a second end, the first end of the second conveyor configured to be positioned at a bottom of the sloped bottom surface of the ramped collector and configured to receive metallic objects directed down the sloped bottom surface.

9. The system of claim 8, further comprising a fifth unit of the plurality of units comprising a barrel, the barrel configured to be positioned below the second end of the second conveyor and the second conveyer configured to drop metallic objects into the barrel.

10. The system of claim 8, further comprising a partition, the partition configured to be positioned to separate the first, second, and third units from the fourth unit.

11. The system of claim 8, further comprising a plurality of wheeled platforms, there being at least one wheeled platform per unit of the plurality of units, each unit configured for transport through a standard doorway on at least one wheeled platform of the plurality of wheeled platforms.

12. The system of claim 8, further comprising a hopper attachable and detachable to the conveyor to direct metallic objects and non-metallic backstop material onto the conveyor.

13. The system of claim 1, wherein an angle of the plurality of baffles is adjustable to further assist in separating the falling metallic objects and non-metallic backstop material.

* * * * *